US006541707B2

(12) United States Patent
Külper et al.

(10) Patent No.: US 6,541,707 B2
(45) Date of Patent: Apr. 1, 2003

(54) USE OF AN ADHESIVE TAPE AS CABLE BANDAGING TAPE

(75) Inventors: Klaus Külper, Pinneburg (DE); Christian Harder, Hamburg (DE); Bernd Höwe, Hamburg (DE); Frank Lange, Hamburg (DE)

(73) Assignee: tesa AG, Hamburg (DE)

( * ) Notice: Subject to any disclaimer, the term of this patent is extended or adjusted under 35 U.S.C. 154(b) by 6 days.

(21) Appl. No.: 09/795,986

(22) Filed: Feb. 28, 2001

(65) Prior Publication Data

US 2002/0125037 A1 Sep. 12, 2002

(30) Foreign Application Priority Data

Mar. 10, 2000 (DE) ..... 100 11 788

(51) Int. Cl.[7] ..... H01B 7/00

(52) U.S. Cl. ..... 174/117 A; 428/317.7; 442/374

(58) Field of Search ..... 174/117 A, 121 R, 174/110 SR; 428/317.7, 352, 354, 317.3; 442/374

(56) References Cited

U.S. PATENT DOCUMENTS 5,629,078 A * 5/1997 Ganschow ..... 428/317.3

FOREIGN PATENT DOCUMENTS

| | | | |
|---|---|---|---|
| EP | 0 942 057 | * | 3/1999 |
| WO | WO 99/245518 | * | 5/1999 |

* cited by examiner

*Primary Examiner*—Chau N. Nguyen
(74) *Attorney, Agent, or Firm*—Norris McLaughlin & Marcus

(57) ABSTRACT

The use of an adhesive tape as a bandaging tape for cables, the cables having a PVC-free sheathing including a PVC-free backing to at least one side of which a pressure-sensitive, acrylate-based adhesive composition has been applied, the adhesive tape causing no damage to the sheathing when bonded to the cables at a temperature of at least 100° C. and for a duration of at least 240 h.

46 Claims, No Drawings

USE OF AN ADHESIVE TAPE AS CABLE BANDAGING TAPE

BACKGROUND OF THE INVENTION

The invention relates to the use of an adhesive tape as a bandaging tape for cables, the cables having a PVC-free sheath.

Electrical and electromechanical components, and the sheathing of electrical leads, frequently comprise polymeric materials, polyvinyl chloride (PVC) representing the most important plastic, owing historically to its availability and to its excellent materials properties and insulating properties.

In particular, sheathings of copper wires consist predominantly of PVC, unless conditions such as high-temperature requirements necessitate alternatives.

In the past, self-adhesive tapes for the mechanical and electrical protection of such cables were developed, such self-adhesive tapes being as generally and extensively used for protecting and insulating, and bandaging, electrical leads and components.

The self-adhesive tapes permit a long-term union to be produced without damage occurring to the cable as a result of interactions between adhesive tape and cable sheathing. The additives in the plasticized PVC, in particular, tend to migrate, and necessitate adhesive tapes tailored specifically to such materials.

Therefore, adhesive tapes having a PVC film backing, in particular, have become established: firstly on account of their mechanical properties, but secondly on account of minimized compatibility problems, since at least backing and substrate consist of the same material.

For specialty applications such as the wrapping of lengths of lead or cable harnesses in domestic appliances, machinery, and especially vehicles, moreover, there is widespread use of self-adhesive tapes which possess a textile backing, for example, a woven polyester or viscous staple fabric.

In discussions concerning the environmental compatibility of PVC, the trend is to replace this material by alternatives. Electrical components and accessories, and also the sheathing of copper cables, are increasingly being produced with other plastics, with more stringent applications involving the use, besides fluoropolymers and thermoplastic elastomers such as Amitel® [DSM Engineering Plastics] or Hytrel® [DuPont], predominantly of polyester plastics.

For the cost-sensitive mass sector, with less stringent temperature requirements, the use of polyolefinic materials is on the increase, especially since the metallocene technology made it possible to formulate for mechanical properties similar to those of plasticized PVC; an additional factor is that the polyolefins per se exhibit outstanding insulating effects on the basis of their chemical composition as pure hydrocarbons.

For cable harnesses in vehicles, as well, the trend is in favor of PVC-free leads of this kind, while components such as plug connections, switches, grooved tubes, etc., are already manufactured predominantly from PVC-free materials.

Lengths of electrical lead, or components, that are wrapped with self-adhesive tapes are required to ensure reliable functioning over the entire lifetime of the product as a whole, such as that of a vehicle, for example. If inappropriate adhesive tapes are selected, there may be instances of incompatibility during the life of the product, which may result in damage to the cable, such damage possibly extending to extreme embrittlement—corrosion and short circuiting, with the risk of failure of the entire electrical/electronics system, are the possible consequences. Especially in the case of vehicles such as automobiles or trucks, the compatibility requirements are very stringent; in the passenger compartment, temperatures may peak at up to 80° C., while in the engine compartment much higher temperatures are present for long periods.

Therefore, for the field of use of the cable wrapping tapes, a long-term test over 3000 hours, in accordance for example with FORD specification S95 GG 14K 024 BA, has established itself as a standard test—specimen cable harnesses are stored at the test temperatures and after fixed periods of time, usually every 500 hours, are bent around a mandrel of defined diameter and then examined for damage; this test runs over a total period of 3000 hours. In addition to purely visual evaluation, in some cases an electrical insulation test takes place as well. The test temperatures are guided by the fields of use of the cable harnesses and are, for example, 90° C. for woven fabric tapes employed in the passenger compartment, in accordance with FORD S95 GG 14K 024 BA. For applications in the engine compartment, long-term temperatures of 125° C. or more are required.

For cable wrapping applications of this kind, adhesive tapes having a tapelike backing based on wovens or stitchbonded webs are known, woven tapes having been obtainable for a relatively long time and tapes having a stitchbonded web backing being described, for example, in DE 94 01 037 U1. Pressure-sensitive adhesive coatings are preferably employed as the adhesive coating.

DE 44 42 092 C1 describes such an adhesive tape, based on stitchbonded webs, which is coated on the reverse of the backing. DE 44 42 093 C1 is also based on the use of a web as backing for an adhesive tape; in this case, a cross-laid fiber web is described which is reinforced by the formation of loops from the fibers of the web; i.e., a web known to the person skilled in the art as Malifleece. DE 44 42 507 C1 likewise discloses an adhesive tape for cable bandaging, but bases it on so-called Kunit or Multiknit webs.

DE 195 23 494 C2 discloses the use of an adhesive tape having a backing comprising nonwoven material for bandaging cable harnesses, said tape being coated on one side with an adhesive. The web employed in accordance with the invention is a spunbonded web of polypropylene, which is thermally consolidated and embossed with the aid of a calender, the embossing roll having an embossing surface of from 10% to 30%, preferably 19%.

DE 298 04 431 U1 likewise discloses the use of an adhesive tape having a backing comprising nonwoven material for the bandaging of cable harnesses, the proposed spunbonded web consisting of polyester.

DE 298 19 014 U1 discloses adhesive tapes based on a web which is consolidated with air and/or water jets. The disadvantage of these backings, despite the mechanical consolidation, is that it is impossible by this technique to rule out the extraction of individual long threads and an adverse effect on the adhesive properties. In the case of very extensive consolidation of the backing, other advantageous backing properties, especially for the harnessing of cables in automobiles, can no longer be obtained.

WO 99/24518 A1 describes an adhesive tape where the backing material is a nonwoven whose suitability for adhesive tape applications derives from the specific selection of fibers or filaments having a fineness of more than 15 denier and from a sheet layer applied additionally by extrusion. The additional extrusion coating required is not the only disadvantage for use; in particular, the restriction to very thick fiber material results in a coarse web which lacks the typically soft, textile character. Denier [den] is a unit which is common in the textile industry, and originates from France, for the linear density (fineness) of yarns. The unit is produced by the equation:

$$\text{linear density} = \frac{\text{filament mass}}{\text{filament length}},$$

a filament having the linear density one denier [1 den] if the weight of a filament 9000 m long is 1 g; correspondingly, 1 g/1000 m=1/9 den (cf. Römpp Lexikon Chemie-Version 2.0, Stuttgart/New York, Georg Thieme Verlag 1999).

In the case of the desired substitution of PVC by polyolefins, in particular, it is found that self-adhesive tapes employed to date consistently have problems with the long-term compatibility. The range of damage which occurs extends from slight cracking in the cable sheathing, owing to embrittlement, through to complete failure by crumbling of components and cable sheathing following prolonged storage.

Adhesive tapes comprising silicone adhesive compositions are known to be of generally good compatibility with virtually all representative plastics in electrical engineering; however, adhesive tapes comprising silicone adhesive compositions are barely used, owing to their high costs and low availability. Moreover, siliconized products are avoided where possible in the automobile sector, owing to the potential hazard during (re)finishing operations, and also in electronics, owing to similar potential hazards.

BRIEF SUMMARY OF THE INVENTION

It is an object of the invention to provide an adhesive tape for use as a bandaging tape for cables, the cables having a PVC-free sheathing, i.e., in particular a polyester or polyolefin sheathing. Bonded in direct contact, during the normal period of use, the adhesive tape should not lead to any damage to the sheathing. It is therefore an object of the invention to eliminate the disadvantages of the prior art entirely, or at least to a considerable extent.

In a manner which was entirely unforeseeable for the skilled worker and is totally surprising, the adhesive tape described in accordance with the invention below is capable of meeting the abovementioned objects.

To achieve the object, the invention proposes the use of an adhesive tape as a bandaging tape for cables, the cables having a PVC-free sheathing comprising a PVC-free backing to at least one side of which a pressure-sensitive, acrylate-based adhesive composition has been applied, said adhesive tape causing no damage to the sheathing when bonded to the cables at a temperature of at least 100° C. and for a duration of at least 240 h.

In one preferred embodiment, the adhesive composition, as a straight acrylic, as a compound and/or as a blend, may be coated from solution, as an aqueous system, or from the melt, as a hot-melt.

By compounds are meant ready-to-process mixtures of polymers in the corresponding additives needed to prepare the end products. Blends are mixtures of polymers.

For compatibility between PVC-free cables and components and the adhesive tape, on the adhesive tape side it is the adhesive composition which is of critical significance. Owing to the direct contact, migration events may lead to changes to the polymer composition and thus to the properties as well: this applies both to the adhesive composition and its adhesive properties, and also, in particular, to the plastic sheathing in the case of cables, and the mechanical and electrical properties.

With particular preference in accordance with the invention, the use of an adhesive tape having an adhesive composition based on acrylate hot-melt meets the abovementioned object. Solvent-free systems based on acrylate hot-melt, as may be used outstandingly for this purpose, are described in EP 621 326 or else in EP 937 761; they are available commercially, for example, from BASF under the designation acResin UV®.

Outstandingly suitable adhesive compositions are those which have a K value of at least 20, in particular more than 30, measured in each case in 1% strength by weight solution in toluene at 25° C. The K value is determined in particular in analogy to DIN 53 726.

Adhesive compositions of this kind are obtainable, for example, by concentrating a solution of a composition possessing the properties set out above to give a system which can be processed as a hot-melt.

Concentrating may take place in appropriately equipped vessels or extruders; especially in the case of accompanying devolatalization, a devolatalizing extruder is preferred.

Advantageous adhesive compositions are described, for example, in DE 43 13 008 A1. In an intermediate step, the solvent is removed completely from the acrylate compositions prepared in this way.

In addition, further volatile constituents may be removed if desired. After coating from the melt, these compositions have only small fractions of volatile constituents. Accordingly, it is possible to adopt all of the monomers/formulations claimed in the above-cited patent. A further advantage of the composition as described in the patent is that they have a high K value and thus a high molecular weight. The skilled worker is aware that systems with higher molecular weights can be crosslinked more efficiently. Accordingly, there is a corresponding reduction in the fraction of volatile constituents.

In a form which is very suitable indeed in accordance with the invention, the solution of the composition contains 5–80% by weight, especially 30–70% by weight, of solvent.

It is preferred to employ commercially customary solvents, especially low-boiling hydrocarbons, ketones, alcohols and/or esters.

Preference is further given to the employment of single-screw, twin-screw or multi-screw extruders having one or, in particular, two or more devolatalizing units.

The adhesive composition may be crosslinkable by chemical or thermal treatment, especially by chemical radiation treatment. Using radiation, the adhesive composition based on acrylate hot-melt can be crosslinked preferably using UV radiation. Other types of crosslinking, however, are also possible, electron beam crosslinking being an example.

In one outstanding embodiment of the invention, the adhesive composition based on acrylate hot-melt may additionally be admixed with substances which can be activated by radiation and/or chemically and/or thermally, and/or they have the substances incorporated into it by polymerization, especially photoinitiators, in particular benzoin derivatives. Examples of such photoinitiators that may be mentioned, without wishing to impose any unnecessary restriction, include benzoin acrylate or benzoin methacrylate, acrylic esters or methacrylic esters. Benzoin derivatives of this kind are described in EP 0 578 151 A.

In one preferred embodiment, self-adhesive compositions employed comprise copolymers of (meth)acrylic acid and esters thereof having 1–25 carbon atoms, maleic, fumaric and/or itaconic acid and/or their esters, substituted (meth) acrylamides, maleic anhydride and other vinyl compounds, such as vinyl esters, especially vinyl acetate, vinyl alcohols and/or vinyl ethers.

The residual solvent content should be below 1% by weight.

In accordance with the invention, only PVC-free sheetlike structures are suitable as backing materials for the adhesive tape, in order to ensure that, following the production of the insulating or protective wrapping, the resulting assemblies continue to be PVC-free. Accordingly, backings employed comprise wovens, knits, nonwoven webs, films, paper, felts, foams, and coextrudates.

Instead of the plasticized PVC films it is preferred to choose stretchable, conforming films of plastics such as polyolefins, or, in particular, textile backing materials.

Known textile backing materials include wovens or knits made from natural fibers such as cotton or from synthetic fibers such as polyester, polyamide, polyethylene, polypropylene, viscous staple, and the like; furthermore, use may be made of a wide variety of nonwoven backings such as, for example, wet-laid webs, water-jet-consolidated webs, or webs consolidated thermally with or without pressure, needlefelts or spunbondeds, stitchbondeds such as Maliwatt or Malifleece webs, provided they are produced from appropriate fibers or filaments. Moreover, it is also possible to use felts, foams, and other kinds of PVC-free backing materials.

Preconsolidated webs are produced, for example, on stitchbonding machines of the "Malifleece" type from the company Karl Meyer, formerly Malimo, and can be obtained, inter alia, from the companies Naue Fasertechnik and Techtex GmbH. A Malifleece is characterized by a cross-laid web being consolidated by the formation of loops from fibers of the web.

The backing used can also be a web of the Kunit or Multiknit type. A Kunit web is characterized by the fact that it originates from the processing of a longitudinally oriented fiber web to form a sheetlike structure which has the heads and legs of loops on one side and, on the other, loop feet or pile fiber folds, but possesses neither filaments nor prefabricated sheetlike structures. A web of this kind has also been produced for many years, for example, on stitch-bonding machines of the "Kunitvlies" type from the company Karl Mayer. A further characterizing feature of this web is that, as a longitudinal-fiber web, it is able to absorb high tensile forces in the lengthwise direction. The characteristic feature of a Multiknit web relative to the Kunit web is that the web is consolidated on both the top and bottom sides by virtue of the double-sided needle punching.

Finally, stitchbonded webs are also suitable as an intermediate for forming an adhesive tape of the invention. A stitchbonded web is formed from a nonwoven material having a large number of stitches extending parallel to one another. These stitches are brought about by the incorporation, by stitching or knitting, of continuous textile filaments. For this type of web, stitch-bonding machines of the type "Maliwatt" from the company Karl Mayer, formerly Malimo, are known.

Starting materials envisaged for the textile backing are, in particular, polyester fibers, polypropylene fibers, viscose fibers or cotton fibers. The present invention, however, is not restricted to the aforementioned materials. Rather, a large number of further fibers can be used to produce the web which are evident to the person skilled in the art without the need for an inventive step.

The basic fibers of the web consist preferably of virgin or reclaimed polyester fibers. These fibers should be between 10 and 100 mm long and should have a linear density of from 1.5 to 10 dtex.

A particularly appropriate application of the adhesive tape of the invention is its use as a bandaging tape for cables, the cables having a PVC-free sheath.

The term cable embraces not only customary cables but also other types, such as plug connections, switches or grooved tubes and the like, for example, which are used in the region of the cable harness.

PVC-free cable sheathings used may be those comprising thermoplastic elastomers, fluoropolymers and polyolefins, but also all other PVC-free plastics. As nonexclusive examples but ones which may be used outstandingly, mention may be made here of polypropylenes, PP/PE copolymers or PP/PE compounds, and also crosslinked polyethylenes.

Acrylic hot-melts may be applied to the abovementioned backings in a variety of ways. Besides the standard application techniques such as direct coating from nozzles, via rollers, etc., transfer techniques as disclosed in DE 43 24 748 C2 are also of advantage, given the open structure of textile backings. In the case of transfer techniques, the adhesive composition is applied first of all to an endlessly rotating, antiadhesively treated belt and then transferred to the backing material in a laminating station, using pressure and temperature if necessary in order to improve the anchoring of the composition.

The desired adhesive properties such as bond strength, tack, and cohesion, may to a certain extent be controlled, and adapted to the requirements, by the concluding mediation-chemical crosslinking. The rolling-up of the backing material into large bales represents the end of the coating process proper.

Adhesive tapes of the invention produced in the desired dimensions by cutting or punching from relatively large bales may be chosen for the bandaging of cables with PVC-free sheathing; in one of the principal applications, for the production of cable harnesses in vehicles, a large number of individual cables are bandaged to form a strand by wrapping the entire bundle. Adequate adhesion of the adhesive tape to the cable sheathing, and to the reverse of its own backing, are important properties which the adhesive tape must have in order to provide durable bandaging of such cable harnesses.

For this purpose, bond strengths in particular of more than 1 N/cm, are required, in particular more than 2 N/cm, as are adhesive composition application rates which in the case of smooth film backings are more than 15 g/m$^2$, in the case of textile backings more than 25 g/m$^2$, more preferably from 50 bis 200 g/m$^2$, depending on the nature of the textile backing.

Cable harnesses bandaged with adhesive tapes of the invention are subjected to substantially standardized tests which are normally found in specific standards of the automobile or electrical manufacturers—for the testing of compatibility, it is common—as a long-term test—to conduct the so-called 3000 hour test, in accordance, for example, with FORD S95GG 14K024 BA.

This test is conducted as an accelerated, rapid test over 10 days at elevated temperature. In accordance with the invention, the adhesive tape causes no damage to the sheathing when bonded to the cables at a temperature of at least 100° C. and for a period of at least 240 h. The period is preferably 480 h, i.e., 24 days, within which no damage occurs.

If the adhesive tape is bonded in applications at a higher temperature, the requirements also become greater. Preferably, the adhesive tape/cable assembly withstands even temperatures above 125° C., with particular preference 150° C.

In the abovementioned rapid tests, the test temperatures are chosen to be 20 to 25° C. higher than the temperatures which actually occur on bonding, in order to rule out definitively any subsequent adverse effects on the sheathing. For the suitability classification 3000 h/125° C., the rapid tests take place at 150° C. for at least 10 days.

Whereas adhesive tapes based predominantly on natural-rubber and synthetic-rubber adhesive compositions prove in many cases to be problematic with regard to compatibility, a considerable improvement is achieved with the self-adhesive tape of the invention.

Besides the improvement in compatibility, the self-adhesive tapes of the invention comprising an acrylic adhesive composition offer a further potential over the majority of the adhesive tapes employed to date. By virtue of the selection of the polymer polyacrylate, which is devoid of relatively large fractions of admixed constituents such as resins, plasticizers, etc., and whose cohesion is significantly increased by crosslinking, there is an improvement in temperature stability over natural-rubber and synthetic-rubber adhesive compositions, both as regards peak temperature loads and as regards long-term temperature loads.

Given an appropriate selection of backing, the increased temperature stability of the adhesive composition extends to the adhesive tape as a whole.

Especially in a combination of the aforementioned adhesive composition with a backing made from polyolefin, a plastic known for its good temperature stability and which is used in the field of electrical adhesive tapes in temperature classes up to and including B (130° C. long-term stability), in certain cases even up to class F (155° C. long-term stability), it is possible to meet the demands for increased stability in the adhesive tapes.

In the text below, the adhesive tape of the invention is described with reference to examples, without wishing to restrict the invention unnecessarily as a result.

EXAMPLE 1

A UV-crosslinkable acrylic hot-melt adhesive composition of the Acronal® DS 3458 type is applied at 50 m/min to a textile backing of the Maliwatt stitchbonded web type (80g/m$^2$ fineness 22, black, thickness approximately 0.3 mm). The temperature load on the backing is reduced by means of a cooled counterpressure roll. The application rate of the composition is approximately 65 g/m$^2$. Appropriate crosslinking is achieved inline, prior to winding, by exposure with a UV unit equipped with 6 medium-pressure Hg lamps each producing 120 W/cm.

EXAMPLE 2

Approximately 50 g/m$^2$ of the same adhesive composition as in example 1 is transferred as a film to the same web backing by the transfer process, by way of a rolling-rod die at a speed of 10 m/min, using a belt, with a pressure of 8 bar and a counterpressure roll temperature of approximately 70 to 80° C. being utilized in the laminating station in order to improve the bond strength between backing and adhesive composition film. The melting temperature of the adhesive composition is approximately 100° C. Crosslinking takes place as described in example 1, but with the emitter output being adapted to correspond with the reduced coating speed.

Both specimens were wound into rods and punched and cut to give standard commercial adhesive tape rolls of 10 linear meters, and were tested for their properties. With bond strengths on steel of >2.5 N/cm, and to their own reverse face of >3.5 N/cm, both specimens reliably meet the requirements for cable wrapping tapes (the bond strengths are measured in accordance with international standard at 1800 and a removal speed of 300 mm/min).

For the compatibility testing, the test method described above is used, being routinely employed, for example, by automobile manufacturers such as Renault, Peugeot, etc.

The specimen cable harnesses are stored at 100° C. for 240 hours or at 150° C. for 240 hours.

To produce the specimens, single-core test cables (preferred wire cross sections of 0.35 or 0.75 mm$^2$) from different manufacturers, with sheathing based on polyolefins, are wrapped with the adhesive tape; following storage, in each case the adhesive tape is removed, the cable is bent back on itself (very high stress owing to narrow radius of flexure) and examined for damage: specifically, there is a visual inspection for embrittlement and cracking, and also a breakdown voltage test at 1 kV for 1 minute.

The results set out in the table apply to adhesive tapes in accordance with examples 1 and 2 based on an acrylic hot-melt adhesive composition of the acResin type.

The comparative example listed is a known standard adhesive tape for bandaging PVC-sheath cables, based on a natural-rubber adhesive composition.

The test is considered to have been passed (assessment: sat) if no damage can be found after 240 hours (corresponding to 10 days at elevated storage temperature).

| | | |
|---|---|---|
| Test temperature: | 100° C. | for class 1 (long-term temperature stability 80° C.); |
| Test temperature: | 150° C. | for class 3 (long-term temperature stability 125° C.). |

| Temperature class | Cable manufacturer | Cable type | Compatibility with adhesive tapes 1 and 2 (acrylic hot-melt) | Compatibility with standard adhesive tape for PVC-cables (natural rubber) |
|---|---|---|---|---|

-continued

| | | | | |
|---|---|---|---|---|
| Class 1 (80° C.) | | | | |
| | A | PP | sat. (>480 h) | |
| | B | PE | sat. (>480 h) | |
| Class 3 (125° C.) | | | | |
| | C | PP | sat (>240 h) | unsat. (about 100 h) |
| | D | PP/PE | unsat. (about 200 h) | unsat. (about 100–150 h) |
| | E | PE | sat. (>240 h) | unsat. (about 175–200 h) |
| | F | PP/PE | sat. (>480 h) | sat. (>240 h) |

What is claimed is:

1. A cable bandaged with an adhesive tape, the cable comprising a PVC-free sheathing, comprising a PVC-free backing to at least one side of which has been applied a pressure-sensitive, adhesive composition based on an acrylate, said adhesive tape causing no damage to the sheathing when bonded to the cable at a temperature of at least 100° C. and for a duration of at least 240 h.

2. The cable as claimed in claim 1, wherein the adhesive composition is at least one of a straight acrylic, compound or blend.

3. The cable as claimed in claim 1, wherein said pressure-sensitive adhesive composition is based on an acrylic hot-melt.

4. The cable as claimed in claim 1, wherein said pressure-sensitive adhesive composition has a K value of at least 20 measured in 1% strength by weight solution in toluene at 25° C.

5. The cable as claimed in claim 4, wherein said pressure-sensitive adhesive composition has a K value of more than 30 measured in 1% strength by weight solution in toluene at 25° C.

6. The cable as claimed in claim 1, wherein the adhesive composition is a concentrate which can be processed as a hot-melt.

7. The cable as claimed in claim 6, wherein the concentrate contains 5–80% by weight of solvent.

8. The cable as claimed in claim 7, wherein the solvent is at least one selected from the group consisting of low-boiling hydrocarbons, ketones, alcohols and esters.

9. The cable as claimed in claim 7, wherein single-screw, twin-screw or multi-screw extruders having one devolatilizing unit are employed.

10. The cable as claimed in claim 7, wherein single-screw, twin-screw or multi-screw extruders having two or more devolatilizing units are employed.

11. The cable as claimed in claim 6, wherein the concentrate contains 30–70% by weight, of solvent.

12. The cable as claimed in claim 1, wherein the adhesive composition is crosslinkable by chemical or thermal treatment.

13. The cable as claimed in claim 12, wherein the chemical or thermal treatment is radiation treatment.

14. The cable as claimed in claim 1, wherein the adhesive composition may be admixed with substances which can be activated by at least one of radiation or chemicals or heat or the adhesive composition incorporates said substances by polymerization.

15. The cable as claimed in claim 14, wherein the substances comprise photoinitiators.

16. The cable as claimed in claim 15, wherein the photoinitiators comprise benzoin derivatives.

17. The cable as claimed in claim 1, wherein the adhesive composition employed comprises at least one of copolymers of methacrylic acid and esters thereof having 1–25 carbon atoms, maleic acid, maleic acid esters, fumaric acid, fumaric acid esters, itaconic acid, itaconic acid esters, substituted methacrylamides, maleic anhydride and other vinyl compounds.

18. The cable as claimed in claim 17, wherein the vinyl compounds are one or more selected from the group consisting of vinyl esters, vinyl alcohols and vinyl ethers.

19. The cable as claimed in claim 1, wherein the adhesive composition comprises vinyl acetate.

20. The cable as claimed in claim 1, wherein said backing comprises wovens, knits, nonwoven webs, films, paper, felts, foams, or coextrudates.

21. A machine comprising a cable according to claim 1.

22. The machine according to claim 21, which is an appliance or a vehicle.

23. The cable of claim 1, wherein the adhesive composition is coated from a solution or from a hot-melt.

24. An adhesive tape for wrapping cables, said tape comprising, a pressure sensitive adhesive composition based on an acrylate applied to at least one side of said tape, wherein said tape is resistant to a temperature of at least 100° C. for a duration of at least 240 hours when said tape is bonded to a PVC-free backing of a PVC-free sheathing of said cables.

25. The tape of claim 24, wherein said adhesive composition is at least one of a straight acrylic, a compound or a blend.

26. The tape of claim 24, wherein said adhesive composition is coated from a solution or from a hot-melt.

27. The tape of claim 24, wherein said adhesive composition is based on an acrylic hot-melt.

28. The tape of claim 24, wherein said adhesive composition has a K value of at least 20 measured in 1% strength by weight solution in toluene at 25° C.

29. The tape of claim 24, wherein said adhesive composition has a K value of more than 30 measured in 1% strength by weight solution in toluene at 25° C.

30. The tape of claim 24, wherein said adhesive composition is a concentrate which can be processed as a hot-melt.

31. The tape of claim 30, wherein said concentrate contains 5–80% by weight of a solvent.

32. The tape of claim 31, wherein said solvent is selected from the group consisting of low-boiling hydrocarbons, ketones, alcohols, and esters.

33. The tape of claim 30, wherein said concentrate contains 30–70% by weight of the solvent.

34. A method of making an adhesive tape for wrapping cables, comprising concentrating said adhesive composition of claim 24 to a concentrate with a single-screw, twin-screw or multi-screw extruders having one devolatilizing unit.

35. A method of making an adhesive tape for wrapping cables, comprising concentrating said adhesive composition of claim 24 to a concentrate with a single-screw, twin-screw or multi-screw extruders having two or more devolatilizing units.

36. The tape of claim 24, wherein said adhesive composition is crosslinkable by chemical, thermal or radiation treatment.

37. The tape of claim 36, wherein said chemical, thermal or radiation treatment is radiation treatment.

38. The tape of claim 24, wherein said adhesive composition is admixed with substances which can be activated by at least one of radiation or chemicals or heat or said adhesive composition incorporates said substances by polymerization.

39. The tape of claim 38, wherein said substances comprise photoinitiators.

40. The tape of claim 39, wherein said photoinitiators comprise benzoin derivatives.

41. The tape of claim 24, wherein said adhesive composition comprises at least one of copolymers of methacrylic acid and esters thereof having 1–25 carbon atoms, maleic acid, maleic acid esters, fumaric acid, fumaric acid esters, itaconic acid, itaconic acid esters, substituted methacrylamides, maleic anhydrides and other vinyl compounds.

42. The tape of claim 41, wherein said vinyl compounds are one or more selected from the group consisting of vinyl esters, vinyl alcohols and vinyl ethers.

43. The tape of claim 41, wherein said vinyl compounds are the vinyl esters.

44. The tape of claim 24, wherein said adhesive composition comprises vinyl acetate.

45. The tape of claim 24, wherein said backing comprises wovens, knits, nonwoven webs, films, paper, felts, foams and coextrudates.

46. A cable wrapped in an adhesive tape according to claim 24.

* * * * *